US007779846B2

(12) United States Patent
Spatafora et al.

(10) Patent No.: US 7,779,846 B2
(45) Date of Patent: Aug. 24, 2010

(54) DEVICE FOR TRANSFERRING AND INSPECTING GROUPS OF CIGARETTES

(75) Inventors: Mario Spatafora, Granarolo (IT); Alberto Casagrande, Castelmaggiore (IT); Sergio Morelli, San Lazzaro di Savena (IT)

(73) Assignee: G.D. S.p.A. (IT)

( * ) Notice: Subject to any disclaimer, the term of this patent is extended or adjusted under 35 U.S.C. 154(b) by 1027 days.

(21) Appl. No.: 11/305,025

(22) Filed: Dec. 19, 2005

(65) Prior Publication Data

US 2006/0180167 A1 Aug. 17, 2006

(30) Foreign Application Priority Data

Dec. 23, 2004 (IT) ..... BO2004A0809

(51) Int. Cl.
*A24C 5/34* (2006.01)

(52) U.S. Cl. ..... 131/280; 209/518

(58) Field of Classification Search ..... 131/282, 131/107, 904–910, 280; 209/356, 518, 535
See application file for complete search history.

(56) References Cited

U.S. PATENT DOCUMENTS 4,511,045 A * 4/1985 Seragnoli ..... 209/535
4,901,860 A * 2/1990 Wahle et al. ..... 209/535
5,569,931 A 10/1996 Ghini
6,531,693 B1 * 3/2003 Focke et al. ..... 250/221
2005/0061611 A1 * 3/2005 Spatafora et al. ..... 198/341.01

FOREIGN PATENT DOCUMENTS

| | | |
|---|---|---|
| EP | 1152944 | 8/2003 |
| EP | 1 502 858 A | 2/2005 |
| IT | 1263459 | 8/1996 |
| WO | 02/095334 A | 11/2002 |

* cited by examiner

*Primary Examiner*—Kat Wyrozebski
*Assistant Examiner*—Daniel Lee
(74) *Attorney, Agent, or Firm*—Timothy J. Klima; Shuttleworth & Ingersoll, PLC

(57) ABSTRACT

Groups of cigarettes approaching a packer are transferred and inspected by a conveyor equipped with receptacles advancing along a set path, and an inspection device such as will verify the presence and the integrity of each cigarette in each receptacle and generate signals to indicate the outcome of the inspection. The conveyor also incorporates emitters in the form of permanent magnets, each associated with a relative receptacle and interacting with a receiver consisting in an array of magnetoresistors ordered along the conveying path; the receiver is capable of emitting signals synchronized with the steps of the inspection procedure and indicating the position of each receptacle relative to a fixed inspection position.

13 Claims, 2 Drawing Sheets

S1
S2
F
II
II

DEVICE FOR TRANSFERRING AND INSPECTING GROUPS OF CIGARETTES

BACKGROUND OF THE INVENTION

The present invention relates to a device for transferring and inspecting groups of cigarettes destined for the wrapping line of a packer.

Groups of cigarettes are transferred as a rule in substantially parallelepiped receptacles affording respective compartments and anchored at constant pitch to an infeed conveyor of the packer machine.

The conveyor, which is driven by a shaft of the machine, consists in an endless belt looped around return rollers. The cigarettes making up each group in a relative compartment are disposed transversely to the feed direction followed by the belt and, in the case of a group of twenty, for instance, arranged in three layers comprising two layers of seven cigarettes each, with a third layer of six cigarettes interposed quincuncially between the two layers of seven.

Thus, each single cigarette of the group occupies a predetermined fixed position internally of the respective compartment.

It is often the case that the group occupying a given compartment will be incomplete, or include at least one substandard cigarette, for example with a shortage of tobacco filler at the one end, or with the filter tip missing from the other end.

To enable the detection and subsequent rejection of defective groups, the machine is equipped with an inspection device, for example of optical type employing photocells, installed at a predetermined inspection position along the path followed by the conveyor. The device in question, for example as described in U.S. Pat. No. 4,511,045, is able to scan the single compartments passing in succession through the inspection position and verify that each one contains the correct number of cigarettes, also that the bare end faces of the cigarettes are properly filled and the opposite ends are furnished with filters.

The inspection of each group and of the single constituent cigarettes occurs with the conveyor in motion and is enabled by a succession of machine cycle signals, each synchronized with a moment in which the inspection device scans the position occupied by the end face of a cigarette making up the group.

The cyclical enabling signals are generated by devices coupled to the shaft of the machine which, to reiterate, is connected mechanically to the conveyor carrying the fixed receptacles.

Signals resulting from the inspection of each compartment are relayed to a memory device and utilized when appropriate to activate a device, positioned along the path of the conveyor, by which the defective groups are ejected.

Self-evidently, the correct operation of an inspection device as described above is dependent on permanently stable timing between the machine shaft, with which the devices emitting the cyclical enabling signals are rigidly associated, and the looped conveyor carrying the receptacles in which the groups of cigarettes are located, or in short, between the enabling signals and the positions of the single cigarettes within the inspected groups.

It has been found however, that as the system becomes affected by backlash, attributable for example to wear in the mechanical linkage between the drive shaft and the conveyor belt loop, or to slack in the belt itself, the aforementioned timing is gradually lost, and the signals emitted by the inspection device no longer reflect the condition of the cigarettes making up the group, resulting as they do from scans effected on positions no longer aligned with the end faces of the cigarettes.

This deleterious loss of timing can also occur as a result of the receptacles not being fixed rigidly to the conveyor, but mounted slidably both relative to the belt and in relation one to another, as is the case with a device of the type described, for example, in patent EP 1 152 944.

As a result of the aforementioned timing being lost, it can happen both that groups of cigarettes including defective items are not ejected, and that groups of perfectly good cigarettes will be ejected in error.

The object of the present invention is to provide a transfer and inspection device in which all of the aforementioned drawbacks are overcome.

SUMMARY OF THE INVENTION

The stated object is realized according to the present invention in device for transferring and inspecting groups of cigarettes, comprising a conveyor caused to advance along a predetermined path and equipped with receptacles each containing a group of cigarettes disposed transversely to the feed direction followed by the conveyor, also an inspection device located at an inspection position, comprising sensing means able to verify the presence and the integrity of each cigarette within each receptacle and generate signals to indicate the outcome of the inspection operation. The device disclosed further comprises emitter means such as will generate signals synchronized with the inspection operation and indicating the position of the receptacle relative to the inspection position.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figures 1, 2:
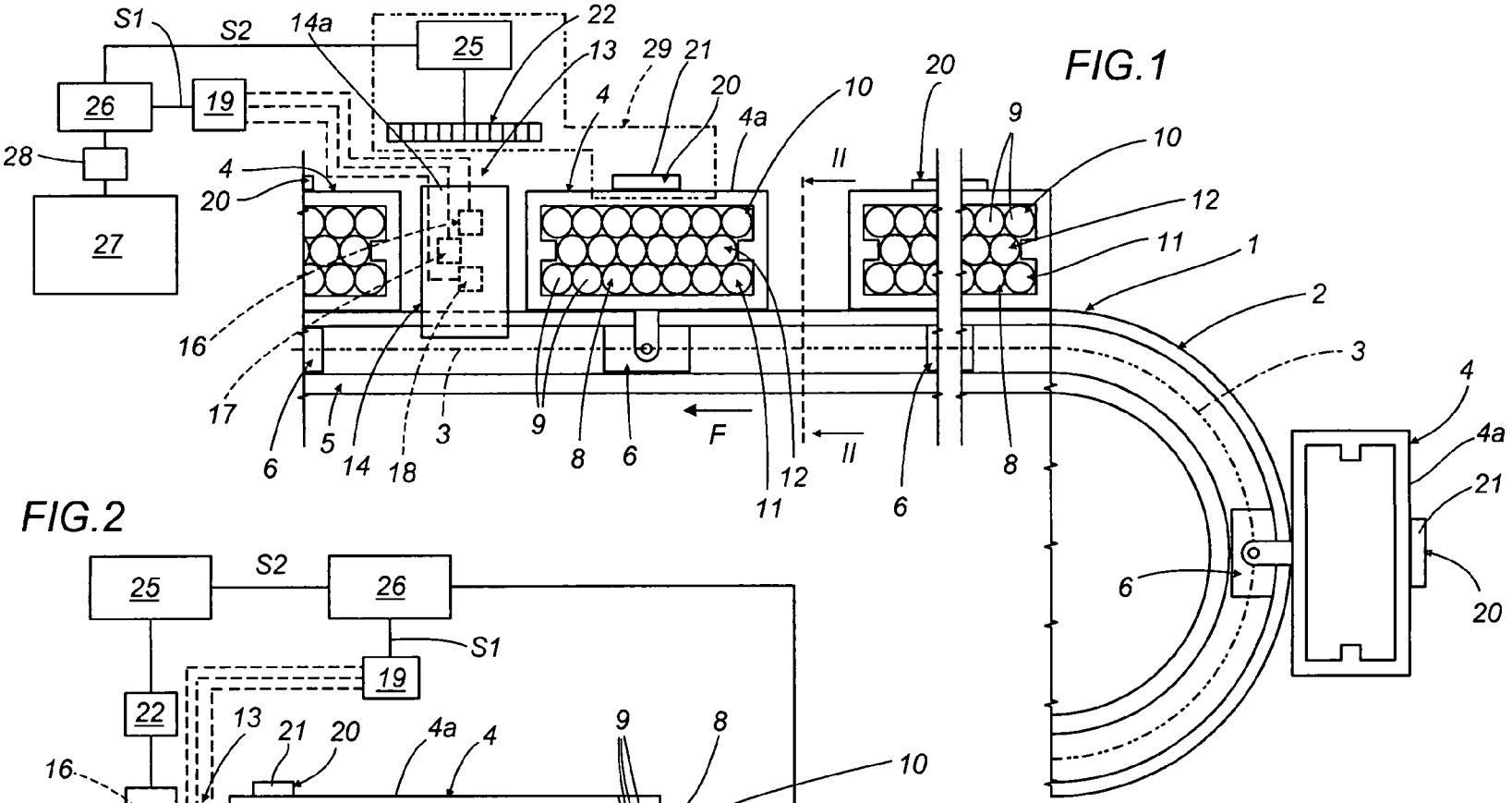
FIG. 1 is a schematic and fragmentary front view of a conveyor carrying groups of cigarettes, equipped with an inspection device embodied in accordance with the present invention.
FIG. 2 is a section taken on II-II in FIG. 1.

With reference to FIG. 1, numeral 1 denotes an endless loop conveyor, in its entirety, of the type described and illustrated in patent EP 1 152 944, referenced here in its entirety, which comprises an endlessly looped track 2 consisting in at least one rail 5 extending along a predetermined path 3. Numeral 4 denotes one of a plurality of receptacles mounted slidably to the conveyor 1.

Associated with each receptacle 4 is a carriage, denoted schematically by a block 6, subject to the action of a magnetic field generated by a set of stator segments (not illustrated) arranged along the conveying path 3 and operating in conjunction with an armature located internally of the block 6.

In practice, as described in patent EP 1 152 944, the stator segments associated with the conveyor 1 and the armatures associated with the blocks 6 provide the primary and the secondary of a linear electric motor by which the receptacles 4 are caused to slide along the tracks 2 according to a given law of motion.

The inside of each receptacle 4 affords a substantially parallelepiped compartment 7 such as will accommodate a group 8 of twenty cigarettes 9 positioned transversely to the feed direction F of the conveyor 1.

The groups 8 are formed by means of conventional type (not illustrated) and consist each in three layers, namely a top layer 10 and a bottom layer 11 both comprising seven cigarettes 9, and, interposed between these two layers, an intermediate layer 12 of six cigarettes 9.

Numeral 13 denotes an inspection position located along the aforementioned conveying path 3, occupied by an inspection device denoted 14 in its entirety.

Figure 4:
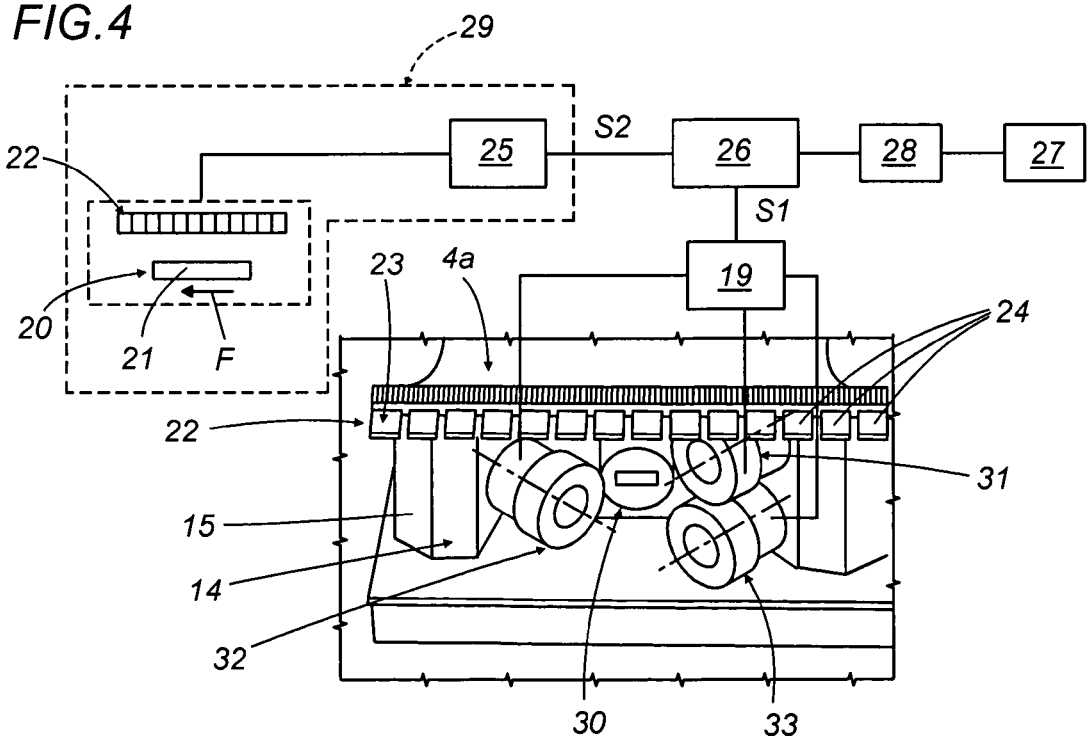
FIG. 4 shows a second embodiment of a detail in FIG. 1, viewed schematically and in perspective.

As shown in FIG. 4, the inspection device 14 is carried by a mounting 15 and comprises three optical type sensing elements denoted 16, 17 and 18 in FIGS. 1 and 2, consisting in reflection photocells of the type described, for example, in U.S. Pat. No. 4,511,045 aforementioned, each positioned level with a respective layer 10, 12 and 11 of cigarettes.

Each of these photocells is composed of a light-emitting element and a light-sensitive element, and will be positioned so as to direct a beam of light at one layer of cigarettes as a receptacle 4 passes through the inspection position 13.

The beams are reflected by the end faces of the cigarettes 9 toward the respective light-sensitive elements, and, in accordance with known principles, the intensity of the reflected light will be proportional to the density of the tobacco filler presented by the scanned cigarette. More exactly, where the end fill of the cigarette is substandard, the intensity of the reflected light beam will be lower than in the case of a correctly filled end.

The photocells 16, 17 and 18 are connected on the output side to a transducer indicated schematically by a block denoted 19, such as will emit electrical signals S1 representative of the luminous intensity detected by the light-sensitive elements at the inspection position 13 and thus indicating the quality of the end fill presented by the single cigarettes 9 and/or the integrity of the group 8 in each compartment 4.

Figure 3:
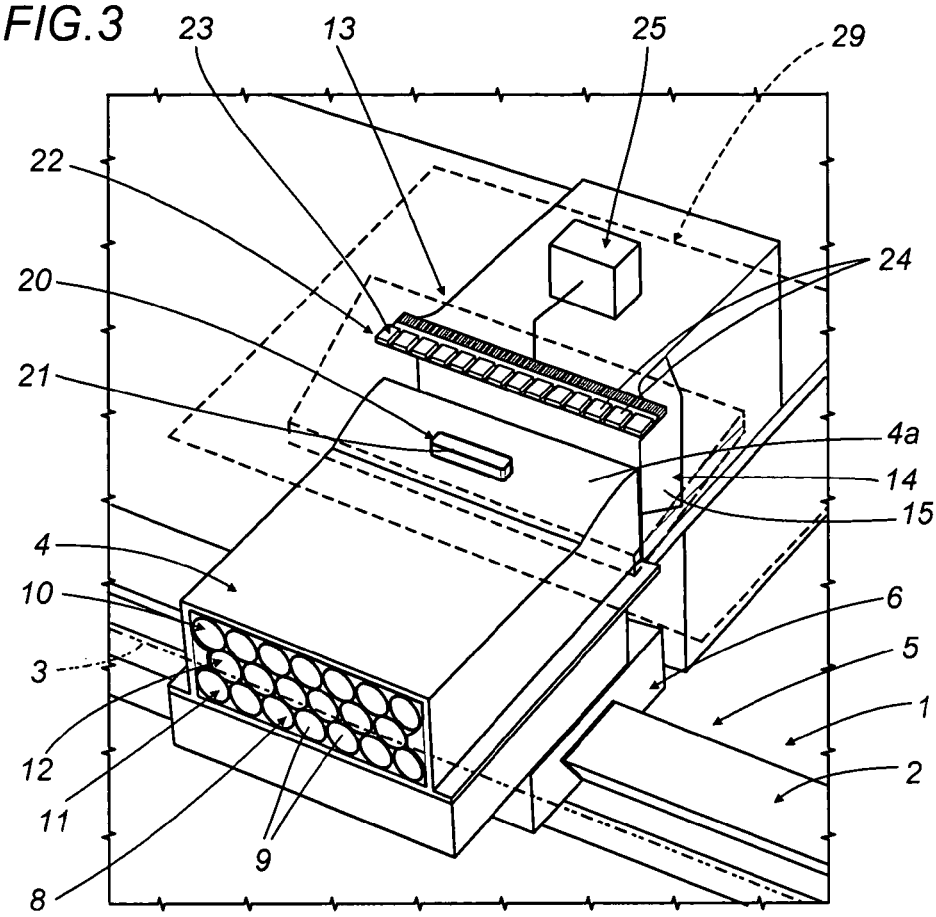
FIG. 3 shows a detail of FIG. 1, viewed schematically and in perspective.

As illustrated in FIGS. 1, 2 and 3, the single receptacle 4 presents a top wall 4*a* affording a surface on which to mount an emitter of magnetic flux 20, for example a permanent magnetic 21.

Also installed at the inspection position 13, carried by the aforementioned mounting 15, is a receiver 22 incorporating a plurality of sensing elements 23 able to detect variations in magnetic field and embodied as magnetoresistors 24 arrayed in succession along the aforementioned path 3, in such a manner as to extend a distance marginally greater than that of the receptacle 4, measured parallel to the conveying path 3.

The receiver 22 is connected on the output side to a processing circuit indicated schematically by a block denoted 25. As each receptacle 4 passes through, the circuit 25 will generate a signal S2 determined by the relative positioning of the magnet 21 and the receiver 22, hence the position of the receptacle 4 and of each cigarette 9 in the compartment, relative to the inspection device 14 and the photocells 16, 17 and 18.

The signals S1 and S2 are directed into a control circuit module 26 of an ejection device 27, by way of a delay timer 28.

The magnetic flux emitter 20, the receiver 22 and the processing circuit 25 thus constitute means 29 by which to emit position signals S2, synchronized with the steps of the inspection procedure to which the invention relates.

It will be evident from the foregoing that such signals S2 consist effectively in a succession of position signals, each synchronized with a moment when one of the sensing elements 16, 17 and 18 scans the end face of a corresponding cigarette 9.

Self-evidently, therefore, the device according to the present invention is able to prevent the loss of timing described with reference to the prior art, ensuring that each position signal produced by the emitter means 29 will function as an enabling signal synchronized strictly with the exact instant in which a single cigarette 9 of a respective group 8 is scanned by the inspection device 14.

In the alternative embodiment of FIG. 4, the inspection device 14 is of a type disclosed in Italian patent IT 1 263 459, referenced here in its entirety, wherein the end faces of the cigarettes 9 making up each group 8 are inspected by a beam from a laser source 30 operating in conjunction with three elements positioned to pick up the reflected laser beam, denoted 31, 32 and 33 and associated respectively with the three layers 10, 12 and 11 of cigarettes.

The output signals from the three elements 31, 32 and 33 are relayed to the transducer 19.

In a further embodiment of the invention, not illustrated in the accompanying drawings, the permanent magnets 21 and the magnetoresistors 24 can be replaced by emitters 20 and receivers 22 of optical type.

What is claimed is:

1. A device for transferring and inspecting groups of cigarettes, comprising:

a conveyor caused to advance along a predetermined conveying path and equipped with receptacles, each receptacle containing a group of cigarettes disposed transversely to a feed direction followed by the conveyor;

an inspection device located at an inspection position for performing an inspection operation, comprising a sensing device for verifying a presence and an integrity of each cigarette within each receptacle and generating first signals to indicate an outcome of the inspection operation;

a device for emitting a succession of second signals directly indicating a position of each receptacle relative to the inspection position, the device for emitting including a plurality of emitters, with each receptacle having at least one emitter positioned at least one of directly on and directly adjacent thereto, the device for emitting also including a receiver located along the predetermined conveying path for interacting with each emitter and directly sensing a position of each receptacle, via the emitter associated therewith, as the receptacle physically passes near the receiver, such that the second signals are directly synchronized with the inspection operation of each cigarette and a constant phase relationship is maintained between the inspection operation of the cigarettes within each receptacle and the position of each receptacle as it passes the inspection device;

a control circuit module configured to receive said first and second signals; and an ejection device by which a selected group of cigarettes can be ejected from its receptacle, wherein the control circuit module has an output connected to the election device to thereby activate the ejection device as a function of the first and second signals.

2. A device as in claim 1, wherein the receiver is located at the inspection position.

3. A device as in claim 2, wherein the emitter and the receiver comprise respectively an inductor and an armature of magnetoelectric type.

4. A device as in claim 3, wherein the emitter comprises a permanent magnet mounted to each receptacle, and the receiver is fixed and comprises a plurality of sensing elements.

5. A device as in claim 4, wherein the sensing elements comprise a plurality of magnetoresistors arrayed in succession along the predetermined conveying path to emit a succession of second signals, each synchronized with a moment when one of a plurality of inspection device sensing elements scans an end face of a corresponding cigarette.

6. A device as in claim 1, wherein the emitter and the receiver comprise respectively an inductor and an armature of magnetoelectric type.

7. A device as in claim 6, wherein the emitter comprises a permanent magnet mounted to each receptacle, and the receiver is fixed and comprises a plurality of sensing elements.

8. A device as in claim 7, wherein the sensing elements comprise a plurality of magnetoresistors arrayed in succession along the predetermined conveying path to emit a succession of second signals, each synchronized with a moment when one of a plurality of inspection device sensing elements scans an end face of a corresponding cigarette.

9. A device as in claim 1, wherein the emitter and the receiver are optical components.

10. A device as in claim 2, wherein the emitter and the receiver are optical components.

11. A device for transferring and inspecting groups of cigarettes, comprising:

a conveyor caused to advance along a predetermined conveying path and equipped with receptacles each containing a group of cigarettes disposed transversely to a feed direction followed by the conveyor;

an inspection device located at an inspection position for performing an inspection operation, comprising a sensor for verifying a presence and an integrity of each cigarette within each receptacle and generating first signals to indicate an outcome of the inspection operation; and a device for emitting second signals indicating a position of the receptacle relative to the inspection position, the signals synchronized with the inspection operation, the device for emitting comprising a plurality of emitters mounted on each receptacle.

12. A device as in claim 11, wherein the plurality of emitters are arrayed in succession along the predetermined conveying path to emit the succession of second signals, each synchronized with a moment when one of a plurality of inspection device sensing elements scans an end face of a corresponding cigarette.

13. A device as in claim 11, and further comprising:

a control circuit module configured to receive the first and second signals; and an ejection device by which a selected group of cigarettes can be ejected from its receptacle, wherein the control circuit module has an output connected to the ejection device to thereby activate the ejection device as a function of the first and second signals wherein the device for emitting emits a succession of second signals directly indicating a position of the receptacle relative to the inspection position, the device for emitting also including a receiver located along the predetermined conveying path for interacting with each emitter and directly sensing a position of each receptacle, via the emitters associated therewith, as the receptacle physically passes near the receiver, such that the second signals are directly synchronized with the inspection operation of each cigarette and a constant phase relationship is maintained between the inspection operation of the cigarettes within each receptacle and the position of each receptacle as it passes the inspection device.

* * * * *